US012599956B2

(12) United States Patent
Volk et al.

(10) Patent No.: US 12,599,956 B2
(45) Date of Patent: Apr. 14, 2026

(54) CASTING APPARATUS, CASTING PROCESS AND CAST COMPONENT

(71) Applicant: Fraunhofer-Gesellschaft zur Foerderung der angewandten Forschung e.V., Munich (DE)

(72) Inventors: Wolfram Volk, Augsburg (DE); Stefan Braunreuther, Augsburg (DE); Thomas Gress, Garching (DE); Simon Schmid, Garching (DE)

(73) Assignee: Fraunhofer-Gesellschaft zur Förderung der angewandten Forschung e.V., Munich (DE)

( * ) Notice: Subject to any disclaimer, the term of this patent is extended or adjusted under 35 U.S.C. 154(b) by 0 days.

(21) Appl. No.: 18/287,981

(22) PCT Filed: Apr. 22, 2022

(86) PCT No.: PCT/EP2022/060769
§ 371 (c)(1),
(2) Date: Oct. 23, 2023

(87) PCT Pub. No.: WO2022/223820
PCT Pub. Date: Oct. 27, 2022

(65) Prior Publication Data

US 2024/0269733 A1 Aug. 15, 2024

(30) Foreign Application Priority Data

Apr. 23, 2021 (DE) ..... 102021204091.8

(51) Int. Cl.
*B22C 9/08* (2006.01)
*B22D 19/00* (2006.01)
*B22D 19/16* (2006.01)

(52) U.S. Cl.
CPC ..... *B22C 9/082* (2013.01); *B22D 19/0009* (2013.01); *B22D 19/16* (2013.01)

(58) Field of Classification Search
CPC .... B22C 9/082; B22D 19/0009; B22D 19/16; B22D 35/00; B22D 35/04; B22D 39/00; B22D 39/02; B22D 39/023; B22D 39/026
See application file for complete search history.

(56) References Cited

U.S. PATENT DOCUMENTS 2,732,601 A * 1/1956 Junghans ..... B22D 41/60 164/488
2003/0079856 A1* 5/2003 Kilmer ..... C22C 21/10 164/487

(Continued)

FOREIGN PATENT DOCUMENTS

CN 107150116 A * 9/2017 ..... B22D 1/00
DE 1583659 A1 8/1970

(Continued)

OTHER PUBLICATIONS

English machine translation of Dieterle DE10342582A1 (Year: 2004).*

(Continued)

*Primary Examiner* — Keith Walker
*Assistant Examiner* — Steven S Ha
(74) *Attorney, Agent, or Firm* — Faegre Drinker Biddle & Reath LLP

(57) ABSTRACT

A casting device and a casting processes for producing a cast component in a mold in which a mold cavity is formed, and a cast component produced by means of the casting process. The casting device includes a first melt feeder, configured to receive a first molten material, a second melt feeder, configured to receive a second molten material, and a feed device configured for simultaneous or temporally independent charging of the mold cavity with the first molten (Continued)

material from the first melt feeder and the second molten material from the second melt feeder by means of gravity. It is provided that the feed device has at least one first outlet that can be introduced into the mold cavity and can be moved relative to the mold cavity in order to charge the mold cavity with the first molten material and/or the second molten material.

9 Claims, 1 Drawing Sheet

(56) References Cited

U.S. PATENT DOCUMENTS

| | | | | |
|---|---|---|---|---|
| 2006/0016576 | A1* | 1/2006 | Beale | B22C 23/02 164/136 |
| 2010/0297467 | A1* | 11/2010 | Sawtell | B22D 7/02 428/615 |
| 2011/0036531 | A1 | 2/2011 | Sears, Jr. | |

FOREIGN PATENT DOCUMENTS

| | | | |
|---|---|---|---|
| DE | 10342582 | A1 | 11/2004 |
| JP | 61-266164 | A | 11/1986 |
| JP | 61-289947 | A | 12/1986 |
| JP | 62-009757 | A | 1/1987 |

OTHER PUBLICATIONS

English Machine Translation of CN-107150116-A (Year: 2017).*

International Preliminary Report on Patentability received for PCT Patent Application No. PCT/EP2022/060769, mailed on Nov. 2, 2023, 15 pages (9 pages of English Translation and 6 pages of Original Document).

International Search Report and Written Opinion received for PCT Patent Application No. PCT/EP2022/060769, mailed on Sep. 5, 2022, 19 pages (9 pages of English Translation and 10 pages of Original Document).

* cited by examiner

CASTING APPARATUS, CASTING PROCESS AND CAST COMPONENT

CROSS-REFERENCE TO RELATED APPLICATION

The present application is the national stage filing of International Application No. PCT/EP2022/060769, filed Apr. 22, 2022, which claims priority to German Application No. 102021204091.8, filed Apr. 23, 2021, the disclosures of which are hereby incorporated by reference.

FIELD OF THE DISCLOSURE

The application is in the field of foundry technology and relates to a casting device and a casting process for producing a cast component in a mold, in particular by means of injector casting, and a cast component produced by means of the casting process. The subject matter of the application may be advantageously used in vehicle construction, aerospace engineering, special machine construction and energy technology.

BACKGROUND

The casting process known as injector casting and suitable casting devices are known from the prior art. In injector casting, a molten material is introduced into a mold cavity through a movable feed device by means of gravity, wherein the feed device is removed from the mold cavity during casting. The molten material is thus introduced into the mold cavity in layers from bottom to top (bottom pouring). During casting, the outlet of the feed device (injector) typically remains beneath the surface level of the melt introduced into the mold cavity.

In the case of known injector casting processes, certain limitations occur with regard to the degrees of freedom in terms of materials and process technology. Desirable properties of such processes include the manufacturability of complex, durable and resilient components, flexibility in the choice of materials, optimized introduction of the melt into the mold cavity in terms of flow behavior, temperature distribution and/or feed capacity, the resource efficiency of the process, and avoiding component scrapping.

SUMMARY OF THE DISCLOSURE

Against the background of the prior art, one object of the present application is therefore to provide a casting device and a casting process and a cast component producible therewith, which have at least some of the properties and improvements mentioned.

To solve the problem, a casting device, a casting process and a cast component according to the claims are proposed. Preferred embodiments and further developments arise in connection with the features of the dependent claims.

The proposed casting device is equipped for producing a cast component in a mold in which a mold cavity is formed. The casting device comprises:

- a first melt feeder, configured to receive a first molten material,
- a second melt feeder, configured to receive a second molten material, and
- a feed device, configured for simultaneous and/or time-independent charging of the mold cavity with the first molten material from the first melt feeder and the second molten material from the second melt feeder by means of gravity.

The mold may be a permanent mold or a lost mold. A melt reservoir, a supply line or a combination of such elements may be referred to here as a melt feeder. The direction, in which gravity acts and against which the mold is filled during casting using the proposed casting device, is hereinafter referred to as the vertical direction, any direction perpendicular thereto as the horizontal direction.

By means of the casting device, the mold cavity may thus be at least sometimes, but also completely simultaneously charged or filled with the first and the second molten material from the respective melt feeders. Before or after the simultaneous charging of both or additional molten materials, the mold cavity may also be charged with only one of the molten materials or with a different selection or composition of molten materials.

It is provided that the feed device comprises at least one first outlet, which may be inserted into the mold cavity and is movable relative to the mold cavity, for charging the mold cavity with the first molten material and/or the second molten material.

Using the proposed casting device, it is easily possible to produce a cast component using two or more molten materials, which differ in at least one melt property (corresponding processes are also subsequently referred to as multi-material injector casting or MMIC). Such melt properties may be a material or a material composition of the respective molten material, but also a melt temperature or some other physical or chemical property of the respective molten material.

Due to the independent selectability of the molten materials and the filling in of the molten materials enabled locally differing mixtures and/or carried out in different mixtures by means of the casting device, process-related and material-related parameters may be varied or optimized across a large range using MMIC. MMIC thus avoids the disadvantages of monolithic casting processes, in which the material used and/or the selected process parameters may represent a compromise, under certain circumstances.

Complex components, in particular components with locally different materials or material properties (functionally graded materials), may be produced using MMIC, wherein transitions between areas of different materials or material properties may be generated as a continuous gradient (hereinafter also referred to as transition gradient) with an adjustable width. The width may be freely varied from very gradual to (almost) step-like transitions. The transition gradient may be carried out linearly or have another (non-linear) profile. Such components may have locally variable properties adapted to their intended use and may be distinguished, for example, by good resilience and/or a good service life.

The process parameters of the casting may also be advantageously varied, spatially or temporally, by means of the different melt properties. In particular, a spatially heterogeneous temperature profile and/or a temporal temperature variation within the material introduced into the mold cavity and/or in the mold itself may be achieved by means of different melt temperatures at a variable mixing ratio. In this way, particularly favorable local feeding properties may be provided. For example, the position and temperature of thermal hotspots within the melt or melt mixture introduced into the mold cavity may be influenced in a targeted manner, by which means the local feeding may be improved, material loss in the feeders may be reduced, and component scrapping caused by cavities may be reduced.

The casting device thus enables numerous process optimizations in terms of automation, suitability for series production, and process efficiency, including the expenditure of time, energy and materials.

The at least one first outlet may be connectable or may be connected to the first melt feeder for charging the mold cavity with the first molten material through a first feed line.

The feed device may comprise at least one second outlet which may be introducible into the mold cavity and may be movable relative to the mold cavity. The second outlet may be connectible or may be connected to the second melt feeder for charging the mold cavity with the second molten material through a second feed line.

The first feed line and the second feed line may be separated from one another in such a way that the first molten material and the second molten material are not mixed with one another within the feed device.

For this purpose, the first and second molten material may be guided in completely separate lines, in particular between the respective melt feeder and the respective outlet; the feed device may thus comprise two fluidically separated injectors.

Mixing the first and second molten material is then carried out only after introduction into the mold cavity. In this way, transition gradients may be generated in the horizontal direction (determined by a horizontal distance between the outlets) and also in the vertical direction (determined by the relative flow rates or flow velocities of the molten materials through the respective outlets).

Like the at least one first outlet, the at least one second outlet is preferably movable relative to the mold cavity. The at least one first outlet and the at least one second outlet may furthermore be moveable relative to each other. This provides additional degrees of freedom with regard to the process and component properties.

The feed device may be equipped to produce a material mixture, comprising respective portions of the first and second molten material, and to charge the mold cavity with the material mixture through the at least one first outlet. In this case, a mixing of the molten materials is thus provided inside of the feed device, which thus forms a common injector for both molten materials.

In order to ensure thorough mixing of the molten materials, a common supply line section may be provided with a sufficient length for both molten materials. Additionally or alternatively, mixing elements may be arranged within a common supply line section.

The feed device may comprise a Y-shaped feed section for producing the material mixture.

Different molten materials may be guided together in this Y-shaped section. More than two feed lines may also open into one another at the same time or in series in a feed section.

Vertical transition gradients, in particular, may be achieved by means of a common injector, wherein good homogeneity may be ensured in the horizontal direction.

The casting device may comprise, in addition to the at least one first melt feeder and the at least one second melt feeder, one or more further melt feeders, each equipped to receive another molten material. The feed device may then be equipped for charging the mold cavity with the one or more additional molten materials simultaneously and/or temporally independently from one another and/or from the first and second melt. Thus, there is a particularly large flexibility with regard to the structure and the complexity of the producible cast components.

Fluidically separated injectors, common injectors or combinations of both variants may be used herein. For example, two or more fluidically separated injector units may be provided, wherein one or more of the injector units may be designed as a common injector for two or more miscible molten materials.

The casting device may comprise a positioning device, for example a robotic device with three translational degrees of freedom, by means of which the at least one first outlet and/or the at least one second outlet may be movable in all three spatial directions relative to the mold cavity. The spatial degrees of freedom of the casting process and the component design are thus maximized.

The casting device may comprise a control device, by means of which a first flow of the first molten material towards the mold cavity and/or a second flow of the second molten material towards the mold cavity may be controlled. The first and second flow may be independently controllable. Depending on the design of the casting device, a controllable mixing of the first and second molten material to form the material mixture within the feed device and/or a controllable ratio of the molten materials entering into the mold cavity through the first and second outlet may be adjustable. The control device may comprise, for example, a plug device and/or a vacuum device for controlling the first or second flow.

The proposed casting process for producing a cast component in a mold includes the following steps:

- providing a casting device of the proposed type,
- providing a mold in which a mold cavity is formed,
- providing a first molten material in the first melt feeder and a second molten material in the second melt feeder,
- introducing the at least one first outlet and/or, insofar as at least one second outlet is provided, the at least one second outlet into the mold cavity,
- charging the mold cavity with the first molten material and the second molten material by means of gravity through the at least one first outlet and/or, insofar as at least one second outlet is provided, the at least one second outlet, moving the at least one first outlet and/or, insofar as at least one second outlet is provided, the at least one second outlet within the mold cavity during the charging, so that the respective outlet is guided during the charging in a defined positional relationship to a surface of the first or second molten material introduced into the mold cavity.

The proposed casting device develops its above-mentioned advantages and properties in the proposed casting process. The casting process may be further developed according to optional features of the casting device or its functions and applications. Conversely, the casting device may be equipped to carry out optional process steps of the casting process.

The first molten material and/or the second molten material may in particular be a metal melt (including an alloy), but other molten materials may also be used in the process.

The first molten material and the second molten material may have different material compositions and/or different temperatures and/or differ in other properties.

The casting process is particularly suitable for processing alloys that are susceptible to cavities, for example, wrought alloys (e.g. wrought aluminum alloys from the 7xxx series, e.g., EN AW-7075), which are otherwise difficult to process in injector casting and related processes.

It may be provided, for example, to increase the temperature of the material mixture introduced into or produced in the mold cavity in a chronologically concluding phase of the casting process, in comparison to previous phases. In this way, a thermal hotspot may be directed to an upper area of the resulting cast component in a targeted way and the feed capability may be improved (i.e., the susceptibility to cavities may be reduced).

The method may comprise: controlling the first flow of the first molten material toward the mold cavity and/or the second flow of the second molten material toward the mold cavity to create a spatially variable mixing ratio of the first molten material and the second molten material within the mold cavity. The proposed cast component may be produced by means of the proposed casting process and has a first area with a first material property formed by the solidification of the first molten material and a second area with a second material property formed by a solidification of the second molten material. In the case of different materials, this means in particular that a proportion of the first material corresponding to the first molten material is higher in the first area than in the second area, while a proportion of the second material corresponding to the second molten material is higher in the second area than in the second area first area. However, a proportion of the second material may also be contained in the first area, and a proportion of the first material may be contained in the second area.

A transition area is formed between the first area and the second area with a continuous transition between the first material property and the second material property.

The cast component is thus, in particular, a functionally graded component and includes at least one transition gradient in the above meaning. Several such transition gradients may also be provided. As mentioned, such a cast component may have, in particular, locally variable properties that are adapted to the intended use and may be distinguished, for example, by good resilience and/or a good service life.

The cast component may be a cast component for vehicle construction, aerospace engineering, special machine construction or energy technology. A vehicle part, for example an engine part, in particular a cylinder crankcase, may be advantageously produced. A cylinder crankcase has respective areas with high and low thermal loads during operation. By means of MMIC, for example, a cylinder crankcase may be produced in a graded design that has a particularly tough material in the crankshaft area and a material with high thermal resistance in the upper crankcase area, through which cracks may be prevented from forming on the combustion chamber webs and a high resistance to friction wear caused by the piston may be guaranteed.

BRIEF DESCRIPTION OF THE DRAWINGS

Exemplary embodiments of the subject matter of the application are subsequently explained by way of the drawings. As shown in each case schematically, FIG. 1 a casting device according to a first example, FIG. 2 a casting device according to a second example.

Repeating and similar features of different embodiments are provided with identical alphanumeric reference symbols in the images.

DETAILED DESCRIPTION OF THE DRAWINGS

Figure 1:
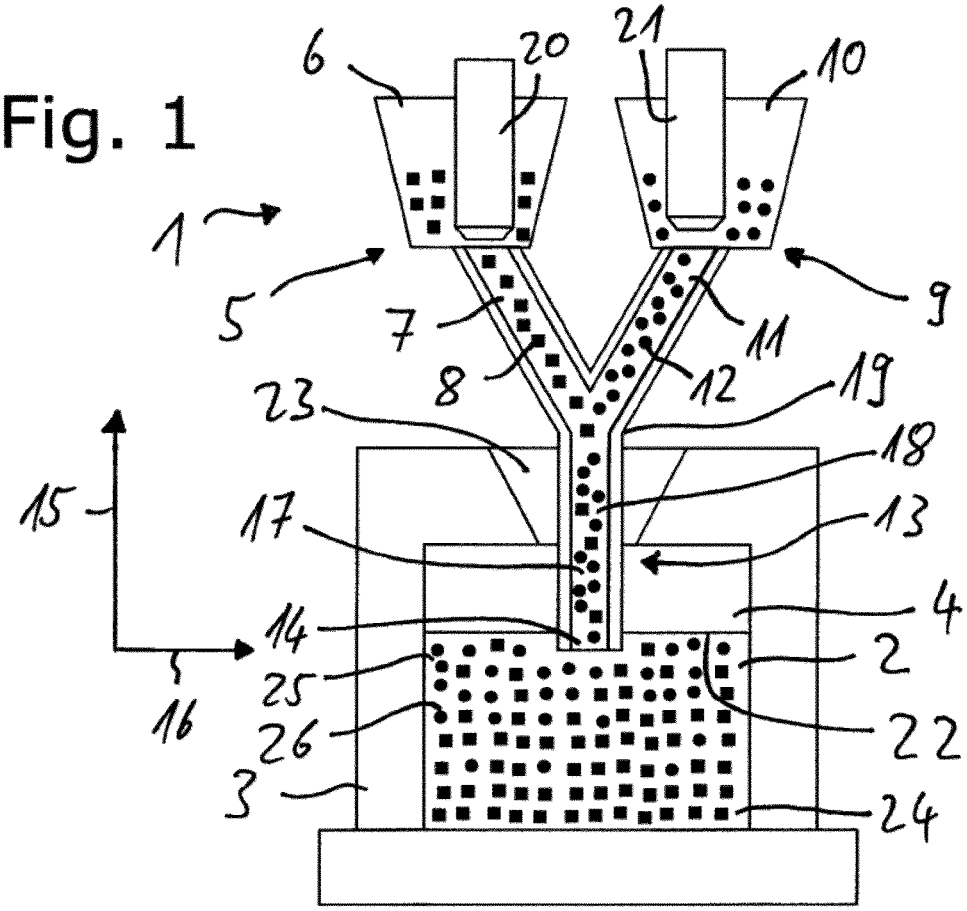

Casting device 1 shown in FIG. 1 is configured for producing a cast component 2 (in the image in the process of being cast) in a mold 3 in which a mold cavity 4 is formed.

Casting device 1 comprises a first melt feeder 5 which comprises a first reservoir 6 and a first supply line 7 which is fluidically connected to first reservoir 6. First melt feeder 5 is equipped to receive a first molten material 8 (represented by square symbols).

Casting device 1 additionally comprises a second melt feeder 9 which comprises a second reservoir 10 and a second supply line 11 which is fluidically connected to second reservoir 10. Second melt feeder 9 is designed to receive a second molten material 12 (represented by circular symbols).

In the example shown, reservoirs 6, 10 are part of casting device 1 and are firmly connected to the respective supply line 7, 11. Alternatively, however, it may be provided that molten materials are to be fed into casting device 1 from external reservoirs or lines that are to be provided separately.

Casting device 1 further comprises a feed device 13, equipped for simultaneous and/or time-independent charging of mold cavity 4 with first molten material 6 from first melt feeder 5 and second molten material 8 from second melt feeder 7 by means of gravity.

The feed device 13 comprises a first outlet 14, which may be introduced into mold cavity 4 and is movable relative to mold cavity 4, for charging mold cavity 4 with first molten material 8 and/or second molten material 12. Feed device 13 and melt feeders 5, 9 preferably comprise a fireproof material and are equipped to receive metal melts. The fireproof material is typically only poorly wettable by metal melts.

The mold 3 is a permanent mold in this example, but may alternatively be a lost mold. The direction, in which gravity acts and against which the mold is filled during the casting using the proposed casting device, is hereinafter referred to as vertical direction 15, any direction perpendicular thereto as horizontal direction 16.

The first outlet 14 is fluidically connected by a first feed line 17 to first melt feeder 5 for charging mold cavity 4 with the first molten material 8 and/or with the second molten material 12.

The feed device 13 is equipped to create a material mixture 18, comprising respective proportions of first and second molten material 8, 12, and to charge mold cavity 4 with material mixture 18 through first outlet 14. The feed device 13 thus forms a common injector for both molten materials 8, 12.

The feed device 13 comprises a Y-shaped feed section for creating material mixture 18. In order to ensure thorough mixing of molten materials 8, 12, the first feed line 17 as a common supply line section is provided with a sufficient length for both molten materials 8, 12. Additionally or alternatively, mixing elements may be arranged within a common supply line section.

The casting device 1 comprises a positioning device (not shown), for example a robotic device with three translational degrees of freedom, by means of which entire feed device 13 including melt feeders 5, 9—and thus in particular the first outlet 14—is movable relative to the mold cavity 4 in all three spatial directions.

The casting device comprises a first control device 20, by means of which a first flow of first molten material 8 to the mold cavity 4 may be controlled, and a second control device 21, by means of which a second flow of second molten material 12 to the mold cavity 4 may be controlled. The control devices 20, 21 are formed as plug devices, but may alternatively be formed as or include vacuum devices or other types of control devices.

The first and second flows are independently controllable from one another in order to achieve a controllable mixing of first and second molten materials 8, 12 to form material mixture 18 within feed device 13, as well as an overall controllable flow of material mixture 18 through the first outlet 14.

The casting device 1 is suitable for a casting process for producing cast component 2 in the mold 3 and is shown in FIG. 1 during use in the casting process.

The casting process comprises the following steps:

- providing the casting device 1,
- providing the mold 3 with the mold cavity 4 formed therein,
- providing the first molten material 8 in the first melt feeder 5 and the second molten material 12 in the second melt feeder 9,
- introducing the first outlet 14 into the mold cavity 4,
- charging the mold cavity 4 with the first molten material 8 and with the second molten material 12 in the form of the material mixture 18, formed within the feed device 13, by means of gravity through the first outlet 14,
- moving the first outlet 14 within the mold cavity 4 during charging, so that the first outlet 14 is guided in a defined positional relationship to a melt surface 22 of the material mixture 18 introduced into the mold cavity 4 during the charging.

FIG. 1 shows the casting device 1, after the first outlet 14 has been introduced into the mold cavity 4 by a feeder 23 of the mold 3, during the charging of mold cavity 4 with molten material 8. The first outlet 14 is thereby positioned just below the melt surface 22 by means of the positioning device.

The first molten material 8 and the second molten material 12 are metal melts of different material composition, wherein other molten materials are also usable in the method (with a corresponding design of casting device 1). The molten materials may additionally have different temperatures and/or differ in other properties.

The casting process also includes controlling the first flow of the first molten material 8 towards the mold cavity and the second flow of the second molten material 12 towards the mold cavity to create a spatially variable mixing ratio of the first molten material 8 and the second molten material 12 within the mold cavity 4.

The cast component 2 produced by means of the casting process (shown in FIG. 1 in a partially produced and not yet fully solidified form) thus has a first area 24 with a first material property formed by solidification of the first molten material 8 (here: high proportion of first molten material 8) and a second area 25 with a second material property formed by solidification of the second molten material 12 (here: high proportion of second molten material 12). A transition area 26 with a continuous transition (transition gradient) between the first material property and the second material property is formed between the first area 24 and the second area 25. Several such transition gradients may also be provided.

The common injector for both molten materials 8, 12, formed by feed device 13 of casting device 1, enables the production of cast component 2 in particular the creation of a transition gradient along vertical direction 15 (as shown in FIG. 1), wherein good homogeneity in horizontal direction 16 may be ensured.

As an additional or alternative step of the casting process, it may be provided that the temperature of the material mixture 18 introduced into the mold cavity 4 is increased in a final temporal phase of the casting process, with respect to previous phases, in particular by providing the first and second molten materials 8, 12 at different temperatures and correspondingly varying the respective flows. In this way, a thermal hotspot may be directed in a targeted manner into an upper area of the cast component 2 being produced and the feeding capability may be improved.

Figure 2:
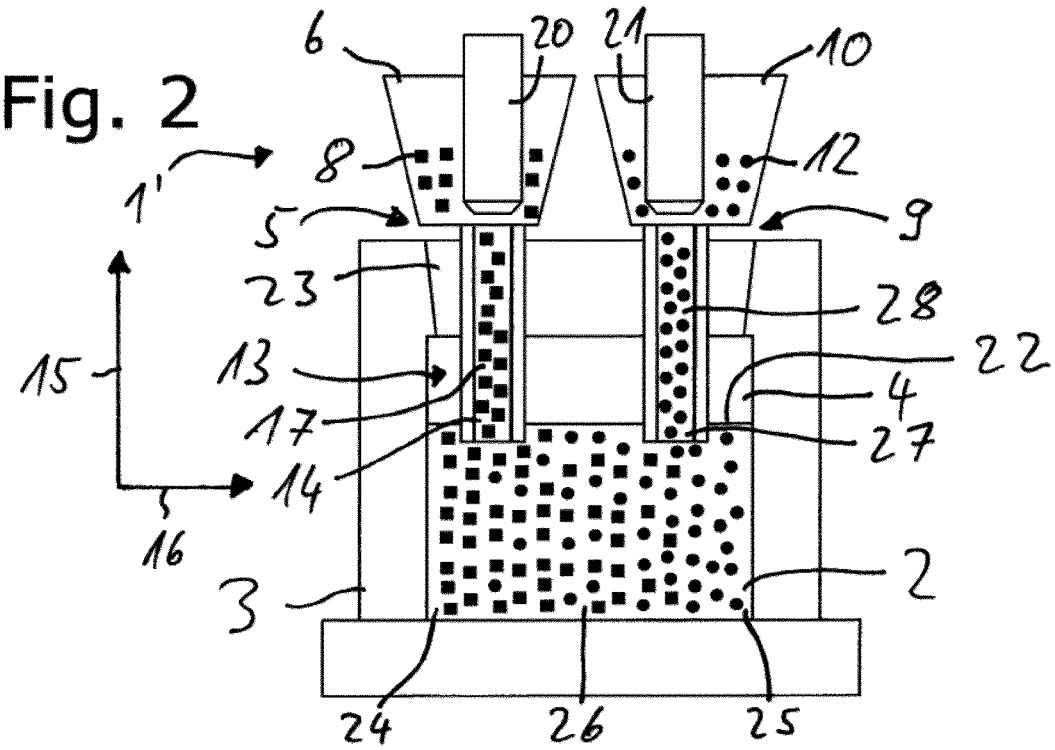

The casting device 1' shown in FIG. 2 differs from the casting device 1 shown in FIG. 1 in particular in that feed device 13 comprises two fluidically separated injectors. Therefore, only the aspects that differ from the casting device 1 are described below.

In addition to the first outlet 14, which is connected to the first melt feeder 5 for charging the mold cavity 4 with the first molten material 8 through the first feed line 17, casting device 1' comprises a second outlet 27, which is connected to the second melt feeder 9 for charging the mold cavity 4 with the second molten material 12 through a second feed line 28.

Like the first outlet 14, the second outlet 27 may also be introduced into mold cavity 4 and may be movable relative to mold cavity 4. The first outlet and 14 and the second outlet 27 are furthermore movable relative to one other (by means of two independent positioning devices (not shown here)).

The first feed line 17 and the second feed line 28 are separated from one another in such a way that the first molten material 8 and the second molten material 12 are not mixed together within the feed device 13.

The casting device 1' is thus suitable for another example of a casting process which is essentially the same as that described above.

Deviating from the previous example, the casting process here comprises:

- introducing the first outlet 14 and the second outlet 27 into the mold cavity,
- charging the mold cavity 4 with the first molten material 8 through the one first outlet 14 and with the second molten material 12 through the second outlet 27 by means of gravity,
- moving the first outlet 14 and the second outlet 27 within the mold cavity 4 during the charging, so that the respective outlet 14, 27 is guided during the charging in a defined positional relationship to the melt surface 22 of the first and second molten materials 8, 12 introduced into the mold cavity 4.

In this example, a mixing of the first and second molten materials 8, 12 is not carried out until after they have been introduced into the mold cavity 4.

In this example as well, by controlling the first flow of the first molten material 8 to the mold cavity 4 and the second flow of the second molten material 12 to the mold cavity 4 by means of the control devices 20, 21, a spatially variable mixing ratio of the first molten material 8 and the second molten material 12 may be created within the mold cavity 4.

The cast component 2' produced in this way (shown in FIG. 2 in a partially produced and not yet fully solidified form) thus also has a first area 24 with a first material property formed by solidification of the first molten material 8 (here: high proportion of the first molten material 8) and a second area 25 with a second material property formed by solidification of the second molten material 12 (here: high proportion of the second molten material 12). A transition area 26 with a continuous transition (transition gradient) between the first material property and the second material property is formed between the first area 24 and the second area 25.

In this example, the transition gradient is arranged in horizontal direction 16 (determined by a horizontal spacing of the outlets 14, 27). In addition, a transition gradient may be created in vertical direction 15, determined by the relative flow rates or flow speeds of the molten materials 8, 12 through the respective outlets 14, 27. Several horizontal and/or vertical transition gradients may also be provided.

In addition to the listed components, the casting device 1 or the casting device 1' may comprise one or more further melt feeders, each equipped to receive a further molten material (exemplary embodiments not shown). Fluidically separated injectors, common injectors or combinations of both variants may be used herein. For example, two or more fluidically separated injector units may be provided, wherein one or more of the injector units may be designed as a common injector for two or more miscible molten materials.

LIST OF REFERENCE NUMERALS

1, 1' casting device
2, 2' cast component
3 mold
4 mold cavity
5 first melt feeder
6 first reservoir
7 first supply line
8 first molten material
9 second melt feeder
second reservoir
11 second supply line
12 second molten material
13 feed device
14 first outlet
vertical direction
16 horizontal direction
17 first feed line
18 material mixture
19 Y-shaped feed section
first control device
21 second control device
22 melt surface
23 feeder
24 first area
second area
26 transition area
27 second outlet
28 second feed line

The invention claimed is:

1. A casting device for producing a cast component in a mold in which a mold cavity is formed, the casting device comprising:

a first melt feeder configured to receive a first molten material, a second melt feeder configured to receive a second molten material, and a feed device configured for one of at least in part simultaneous and at least in part temporally overlapping charging of the mold cavity with the first molten material from the first melt feeder and the second molten material from the second melt feeder by means of gravity, wherein the feed device has at least one first outlet that can be introduced into the mold cavity and can be moved relative to the mold cavity in order to charge the mold cavity with at least one of the first molten material and the second molten material, and further comprising a positioning device by means of which the at least one first outlet is movable relative to the mold cavity in all three spatial directions, wherein the feed device comprises a common supply line section for creating a material mixture comprising respective proportions of the first molten material and the second molten material, and the feed device is configured for charging the mold cavity with the material mixture through the at least one first outlet.

2. The casting device of claim 1, wherein the feed device comprises a Y-shaped feed section for creating the material mixture.

3. A casting method for producing a cast component in a mold, the casting method comprising the steps of:

providing a mold in which a mold cavity is formed, providing a casting device comprising:

a first melt feeder configured to receive a first molten material, a second melt feeder configured to receive a second molten material, and a feed device configured for one of at least in part simultaneous and at least in part temporally overlapping charging of the mold cavity with the first molten material from the first melt feeder and the second molten material from the second melt feeder by means of gravity, wherein the feed device has at least one first outlet that can be introduced into the mold cavity and can be moved relative to the mold cavity in order to charge the mold cavity with at least one of the first molten material and the second molten material, providing the first molten material in the first melt feeder and the second molten material in the second melt feeder, introducing the at least one first outlet, charging the mold cavity with the first molten material and with the second molten material by means of gravity through the at least one first outlet, moving the at least one first outlet vertically within the mold cavity during the charging so that the at least one first outlet is guided during the charging such as to maintain a defined vertical positional relationship to a vertically rising surface of the first molten material or the second molten material introduced into the mold cavity.

4. The casting method of claim 3, wherein at least one of the first molten material and the second molten material is a metal melt.

5. The casting method of claim 3, wherein introducing the at least one first outlet into the mold cavity comprises introducing both the at least one first outlet and the at least one second outlet into the mold cavity.

6. The casting method of claim 3, wherein charging the mold cavity with the first molten material and with the second molten material by means of gravity through the at least one first outlet comprises charging the mold cavity with the first molten material and with the second molten material by means of gravity through both the at least one first outlet and the at least one second outlet.

7. The casting method of claim 3, wherein moving the at least one first outlet within the mold cavity during the charging comprises moving both the at least one first outlet and the at least one second outlet within the mold cavity during the charging.

8. The casting method of claim 3, wherein in the defined vertical positional relationship, the at least one first outlet is continuously positioned just below the vertically rising surface of the first molten material or the second molten material introduced into the mold cavity.

9. The casting method of claim 3, wherein at least one of:

the first molten material and the second molten material have different material compositions; and the first molten material and the second molten material have different temperatures.

* * * * *